US006132922A

United States Patent [19]

Fukae et al.

[11] Patent Number: 6,132,922

[45] Date of Patent: Oct. 17, 2000

[54] LIQUID DEVELOPER FOR ELECTROPHOTOGRAPHIC PRINTING APPARATUS

[75] Inventors: Kensuke Fukae, Boulder, Colo.; Ichiro Yoshida, Tokyo, Japan

[73] Assignee: Advanced Color Technology, Inc., Boulder, Colo.

[21] Appl. No.: 09/226,001

[22] Filed: Jan. 6, 1999

[51] Int. Cl.[7] ..... G03G 9/135

[52] U.S. Cl. ..... 430/117; 430/115

[58] Field of Search ..... 430/114, 115, 430/117

[56] References Cited

U.S. PATENT DOCUMENTS

| | | | |
|---|---|---|---|
| 3,806,354 | 4/1974 | Amidon et al. . | |
| 3,901,600 | 8/1975 | Yoeger et al. . | |
| 3,954,640 | 5/1976 | Lu et al. . | |
| 4,007,041 | 2/1977 | Chow . | |
| 4,119,461 | 10/1978 | Yamada et al. . | |
| 4,574,114 | 3/1986 | Tsutsumi et al. . | |
| 4,740,443 | 4/1988 | Nakahara et al. . | |
| 5,155,534 | 10/1992 | Kurotori et al. . | |
| 5,266,458 | 11/1993 | Matsibayashi et al. . | |
| 5,300,390 | 4/1994 | Landa et al. | 430/115 |
| 5,383,008 | 1/1995 | Sheridon | 355/256 |
| 5,384,225 | 1/1995 | Kurotori et al. . | |
| 5,457,002 | 10/1995 | Beack et al. . | |
| 5,463,453 | 10/1995 | Kurotori et al. . | |
| 5,612,162 | 3/1997 | Lawson et al. . | |
| 5,642,188 | 6/1997 | Mochizuki et al. . | |
| 5,826,145 | 10/1998 | Fukae | 399/233 |

FOREIGN PATENT DOCUMENTS

| | | |
|---|---|---|
| 6-214431 | 8/1994 | Japan . |
| 7-261466 | 10/1995 | Japan . |

*Primary Examiner*—John Goodrow
*Attorney, Agent, or Firm*—Daniel N. Fishman

[57] ABSTRACT

A high viscosity, high solid volume liquid ink for use in electrophotographic printing systems. A silicone oil carrier material is combined with toner particles (including pigment, binder polymers and charge control agents) in a ratio of about 45% toner particles to 55% carrier liquid. The resultant ink preferably has a viscosity in the range 30000 to 50000 cs. The high viscosity ink of the present invention is preferably applied to a photoconductor material having a latent charged image thereon and a thin pre-wet material applied thereto. The pre-wet material is preferably a low viscosity silicone oil material. The composite layer of the combined low viscosity pre-wet and high viscosity ink permits the polymerized toner particles to migrate toward the latent charged image on the photoconductor surface. The high viscosity ink of the present invention helps maintain uniform dispersion of the toner particles in the liquid carrier. The high solid volume of the ink enables the transfer of less ink to the imaging components of the printing system and thereby enables higher speed printing of images. The chemical inertness of the silicone oil liquid carrier as compared to other known hydrocarbon based carrier materials causes less damage to the imaging components of the printing system.

11 Claims, 2 Drawing Sheets

LIQUID DEVELOPER FOR ELECTROPHOTOGRAPHIC PRINTING APPARATUS

RELATED PATENTS

This patent is related to commonly owned U.S. Pat. No. 5,826,145, entitled Electrophotographic Printing Apparatus With A Liquid Development System, issued Oct. 20, 1998, which is hereby incorporated by reference.

BACKGROUND OF THE INVENTION

1. Field of the Invention

The invention relates to electrophotographic printing processes and in particular relates to liquid developer and associated apparatus and processes for creating a latent image on a photosensitive element of a printing system.

2. Discussion of Related Art

Electrophotographic printing systems are used to generate high quality printed images on ordinary paper or other media. Such electrophotographic printing systems are used in copying devices to duplicate images, facsimile machines to receive images and print them on paper and printing devices attachable to computer systems to present printed output from a computer program. Such electrophotographic printing systems are also referred to herein broadly as electrophotographic imaging systems, EP imaging systems, or simply imaging systems or EP systems.

In general, such EP systems include a photosensitive conductor surface—typically in the form of a rotating drum or belt. The photosensitive conductor (also referred to herein as photoconductor or PC) is a dielectric material that holds a charge. The charge retention of the PC is proportional to its exposure to a light source. A precision light source is therefore used to controllably expose individual points on the PC surface. Each such point is referred to as a picture element or pixel. Each pixel therefore represents a light or dark spot on an image to be printed on paper. The light or dark character of the pixel is proportional to the charge retained at that point.

The surface of the PC is said to contain a latent image. The collection of charged and uncharged pixels represents the image to be transferred to the paper or other printing medium. A developer component is associated with the PC component to apply oppositely charged toner particles to the PC. The latent charged image is said to be developed by transfer of the toner particles to the PC. The latent image is then represented by the charged toner particles electrostatically held to the PC.

The developed latent image is then transferred to a piece of paper or other medium by another electric field generated by a transfer component associated with the PC and developer component. The transfer component generates an oppositely charged field on the paper to cause the toner particles to transfer to and electrostatically adhere to the sheet of paper.

A fixing component then fixes the toner particles to the paper by appropriate heating and/or pressure.

The combination of the PC, the developer component and the transfer component is referred to herein as an imaging station. The fixing component may also be grouped into the term imaging station where there a one to one correspondence of fusing components to PCs. As noted below, however, there are situations where there may be multiple PCs (multiple imaging stations) that share a common fixing component.

Some EP systems include multiple PC components (and associated developer and transfer components) to enable multiple color printing. Each of the multiple imaging stations is responsible for a different toner imaging process. For example, a full color printer typically utilizes four PC components—one for each of the three primary colors and one for black. A highlight color printer may use two PC components—one for black and one for a highlight color or MICR (magnetic toner). A number of factors in the process may dictate whether such multiple imaging stations each include a fixing component or whether the imaging stations share a fixing component.

Many electrostatic developing systems use dry particle toners to create toned images on the PC. However, dry particle toners have numerous disadvantages. Because small dry toner particles become readily airborne, causing health hazards and machine maintainability problems, their diameters are seldom less than 3 microns, which limits the resolution obtainable with dry toner particles. Further, thick layers of dry toner, such as are necessary in color images, cause significant paper curl and thereby limit duplex applications. Therefore, there has been a great desire to develop liquid development components for EP printing systems.

Liquid ink development systems are generally capable of very high image resolution because the toner particles can safely be ten or more times smaller than dry toner particles. Liquid ink development systems show impressive gray scale image density response to variations in image charge and achieve high levels of image density using small amounts of liquid developer. Additionally, the systems are usually inexpensive to manufacture and are very reliable. However, present liquid ink development systems are based on volatile liquid carriers and, as a result, they pollute the environment. Consumers are often wary about using such liquid development systems for fear of health hazards. Therefore, there is a strong desire for a liquid ink development system that does not create airborne pollution.

Current liquid ink developers generally utilize low viscosity and low solids. Lower viscosity inks with lower volumes of solids (pigment and associated binders) give rise to two additional problems. First, maintaining uniform dispersion of the pigment particles is more difficult in a low viscosity carrier. The pigment particles have a tendency to drift and settle in the carrier liquid. Furthermore, low volume of solids in the ink increases the amount of ink required to generate a given latent image. More ink will have to be transferred to the photoconductor in order to provide sufficient pigment particles for a desired image density.

Larger amounts of carrier liquid associated with required larger volumes of ink creates the additional problems of transferring the higher volume of material to the photoconductor surface and removing the excess liquid carrier from the printed image. The higher volume of ink required can be a limiting in the print speed of the printing system.

In addition, present liquid ink developers often utilize highly volatile liquid carrier systems such as hydrocarbons. This results in the need to recover or vent the carrier fluids to avoid environmental problems in a common office work environment. In addition, such chemically active carrier liquids can cause harm to components of the image generation system. For example, an organic photoconductor material may be damaged over time from use of such chemically active carrier liquids.

SUMMARY OF THE INVENTION

The present invention solves the above and other problems, thereby advancing the state of the useful arts, by providing a liquid ink for use in electrophotographic printing systems and by providing associated development apparatus and processes and manufacturing processes. Specifically, the liquid ink of the present invention is relatively high viscosity having relatively high solid volume as compared to prior known liquid inks. The ink of the present invention has physical and chemical properties similar to known inks used in offset printing technologies. The ink of the present invention distinguishes from such offset printing inks in that the electrostatic properties are more finely tuned through use of silicone oil and charge control agents to enable improved image quality in electrostatic (electrophotographic) printing systems.

The high viscosity ink is preferably utilized in conjunction with a printing system that applies a lower viscosity pre-wet material to the photoconductor. The pre-wet material is preferably also silicone oil but has a lower viscosity than the carrier liquid used in the liquid ink. The ink of the present invention then provides a carrier of toner particles that migrate through the composite layer of high viscosity ink and low viscosity pre-wet to form the latent image.

Still more specifically, the ink of the present invention comprises, in a first preferred embodiment, approximately 45% solids and 55% carrier. The solids are polymerized particles including the pigment particles, binder components and charge control agents. The carrier is preferably silicone oil having a viscosity of approximately 10 cs. The resulting ink has a viscosity of 30000 to 50000 cs.

The higher solids of the ink of the present invention provide the benefit of requiring a lower volume of ink for transfer to the photoconductor for latent image generation thereon. Further, the higher solid volume of the ink generates less excess carrier for removal from the printed page and the printing system. The higher viscosity of the carrier and resultant ink helps maintain uniform dispersion of the toner particles in the ink. Further, the use of a low volatility silicone oil as a carrier liquid reduces environmental concerns for the operator environment as well as for recycling of any excess carrier liquid. The relative inertness of the carrier liquid of the present invention also causes less damage to imaging system component as compared to past liquid inks using chemically active carrier liquids.

The preferred embodiment generates relatively low molecular weight polymer molecules surrounding the pigment particles. Specifically, the polymer molecules of the preferred embodiment of the toner in the present invention have a molecular weight of between 3000 and 5000. This smaller molecule further aids in maintaining the dispersion of the toner particles within the carrier liquid.

DETAILED DESCRIPTION OF THE PREFERRED EMBODIMENTS

Figure 1:
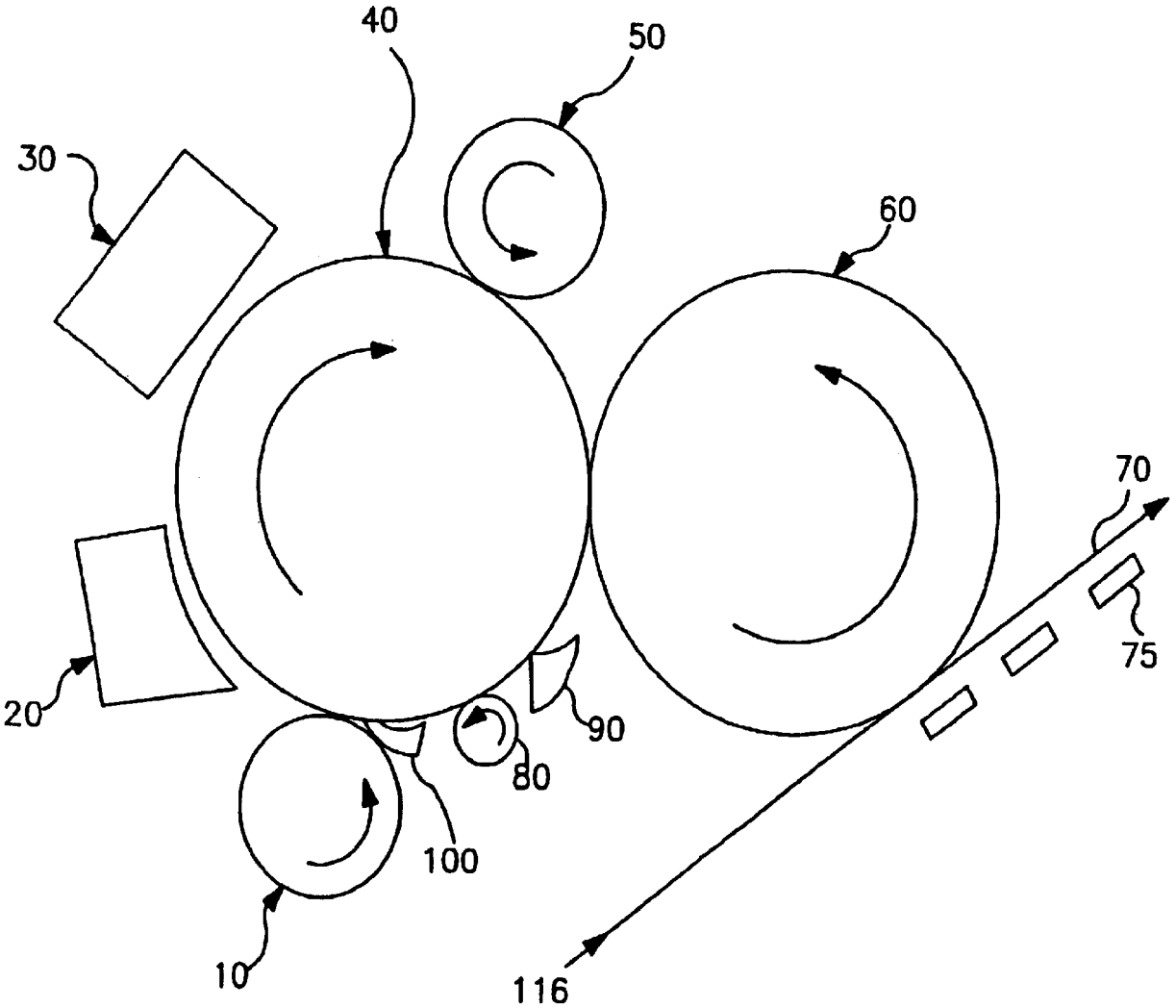
FIG. 1 depicts an exemplary embodiment of an imaging system that may advantageously utilize the liquid ink of the present invention.

While the invention is susceptible to various modifications and alternative forms, a specific embodiment thereof has been shown by way of example in the drawings and will herein be described in detail. It should be understood, however, that it is not intended to limit the invention to the particular form disclosed, but on the contrary, the invention is to cover all modifications, equivalents, and alternatives falling within the spirit and scope of the invention as defined by the appended claims.

EP Printing Systems

Figure 2:
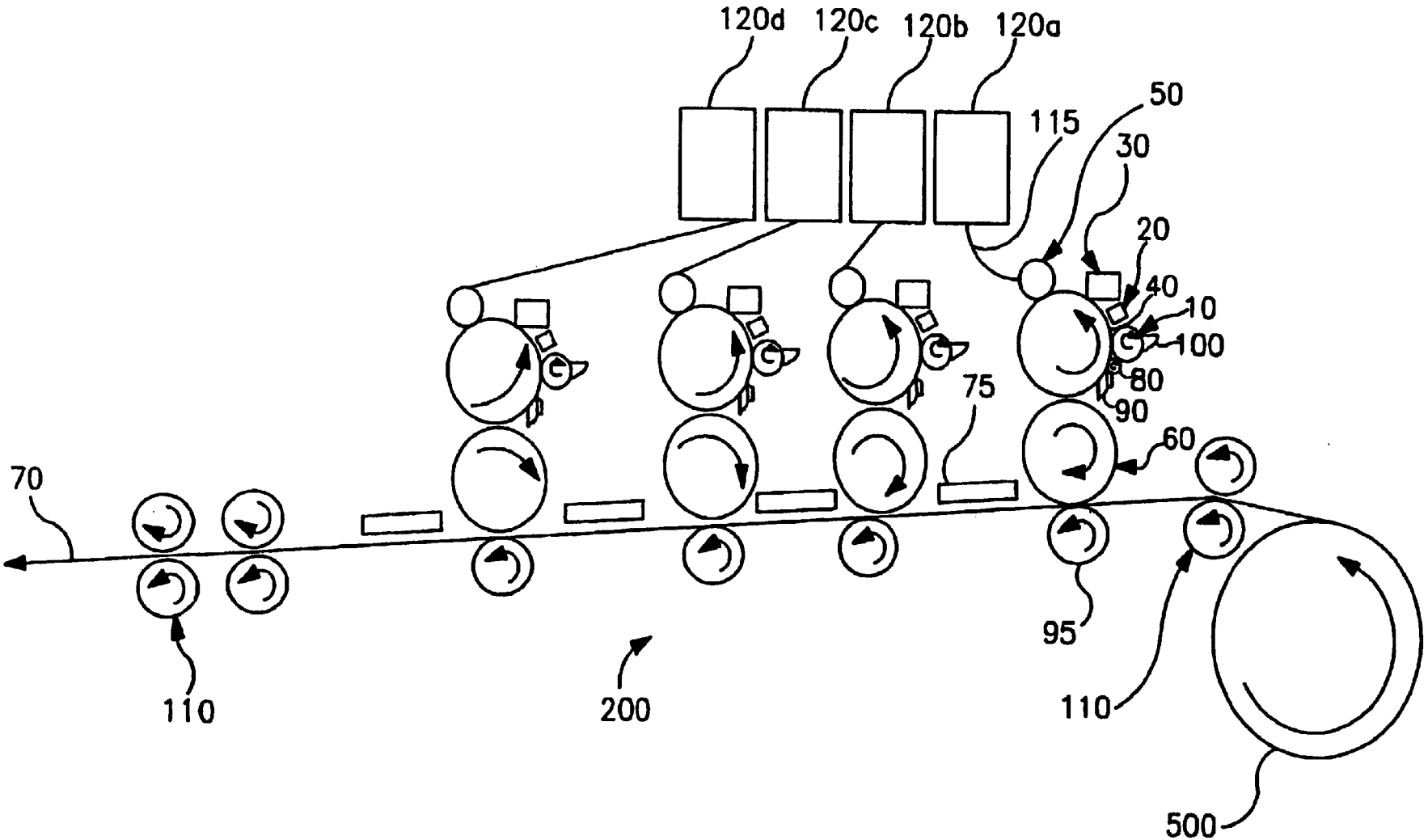
FIG. 2 depicts an exemplary embodiment of four imaging systems in a full color printing system that may advantageously utilize the liquid ink of the present invention.

FIGS. 1 and 2 depict imaging stations of EP printing systems that may advantageously utilize the liquid ink of the present invention.

FIG. 1 illustrates an electrophotographic printing apparatus, an imaging station, which uses an electrophotographic process. The electrophotographic printing apparatus (imaging station) of FIG. 1 comprises a photoconductor 40 that has a surface that is capable of bearing a charge. For example, the surface of the photoconductor 40 may be made from an organic material capable of bearing and retaining a charge. Such organic materials are well known to those skilled in the art.

The photoconductor 40 is rotatable and is in direct contact with a pre-wetting roller assembly 10. Pre-wetting roller assembly 10 has a reservoir 100 connected to it that stores excess pre-wetting oil. The pre-wetting roller assembly 10 coats the photoconductor 40 with a thin layer of pre-wetting oil. The pre-wetting oil is a chargeable silicone oil that has a high volume resistivity, such as a dimethyl polysiloxane fluid (D.C. 200) available from Dow Corning. Preferably, the oil viscosity is between 0.5 mPs and 5 mPs. The high volume resistivity of the silicone based prewetting oil preserves the latent image on the photoconductor 40 once it is formed. A layer 5 to 10 microns thick of the pre-wetting oil is applied to the photoconductor 40 by pre-wetting roller assembly 10.

The 5 to 10 micron thickness of pre-wetting oil is achieved by transferring the pre-wetting oil from the reservoir 100 to photoconductor 40. Transferring the prewetting oil from one roller to the next methodically reduces the thickness of the prewetting oil so that a 5 to 10 micron thickness is eventually applied to the photoconductor 40.

Once the photoconductor 40 is coated with pre-wetting oil, the thin layer of the pre-wetting oil on the photoconductor 40 is uniformly charged to a relatively high, substantially uniform, potential by a corona 20. The corona 20 charges the coated photoconductor 40 as it rotates past the corona 20. Once charged, the coated photoconductor 40 continues to rotate so that its surface is positioned in the path of a light source 30 such as, e.g., an array of light emitting diodes (LED's) or a laser light source. The light source 30 is connected to an external control device, such as a computer, which controls the light emitted by the light source 30. An electrostatic latent image is produced on the coated photoconductor 40 by selectively exposing the coated photoconductor 40 in a manner that dissipates selected areas of charge from the uniformly charged pre-wetting oil. The electrostatic latent image that is produced on the photoconductor 40 corresponds to the informational areas of the document to be printed. Once the latent image is produced on the photoconductor 40, the photoconductor 40, now bearing an electrostatic latent image, continues to rotate so that it comes into contact with an ink head assembly 50.

When the ink head assembly 50 comes into contact with the latent image in the photoconductor 40, it advances a developing solution consisting of toner particles suspended in an oil solution, onto the coated photoconductor 40. Preferably, the developing solution is 45% solid toner particles and 55% oil. The oil has a viscosity of about 10 cs. A preferred thickness of the developing solution deposited on the coated photoconductor 40 is between 5–10 microns. This preferred thickness is maintained by roller assembly 10.

The toner particles in the oil solution pass by electrophoresis to the electrostatic latent image on the photoconductor 40. The toner particles have an opposite charge to the discharged areas of the electrostatic latent image on the photoconductor 40. this enable the toner particles to adhere to the latent image on the photoconductor 40. For example, assuming the discharged areas on the surface of the photoconductor 40 are negatively charged, then the toner particles used must be positively charged so that they are attracted to the discharged areas forming the electrostatic latent image on the photoconductor 40. The polarity of the discharged areas of the photoconductor 40 is a function of the composition of the pre-wetting oil as well as the composition of the photoconductor 40. The toner particles that will be used depend on the polarity of the charged photoconductor 40.

The photoconductor 40 is in direct contact with a transfer drum 60. Once the electrostatic latent image on the photoconductor 40 is then rotated so that the developed image comes into contact with the surface of the transfer drum 60. The developed image is then transferred from the surface of the photoconductor 40 to the transfer drum 60 by direct contact. The transfer drum 60 rotates in a direction that is counter to the direction of rotation of the photoconductor 40.

After the developed image is transferred to the transfer drum 60, the residue of toner particles and pre-wetting oil that remains on the photoconductor 40 is cleaned from the surface of the photoconductor 40 by a cleaning roller 80. As the residue is cleaned from the surface of the photoconductor 40, it is deposited into a waste bin 90. After the surface of the photoconductor 40 is cleaned, it is now ready for the next latent image.

As the transfer drum 60 continues to rotate, the developed image comes into direct contact with a substrate 70 traveling along a paper path 116 in the printing apparatus. One example of a substrate 70 is bonded paper. The developed image on the transfer drum 60 is transferred to the substrate 70 by direct contact pressure. After the developed image has been transferred to the substrate 70, it can be dried by a dryer unit 75 that is positioned along the pathway of substrate 70. Alternatively, the substrate can be allowed to air dry.

One advantage that is realized when using the inventive liquid development system is the speed and sharpness with which sheets can be printed. The inventive electrophotographic printing apparatus is capable of printing about 120 pages per minute in simplex format with a clarity of 1200 pixels or dots per square inch (DPI). Another advantage of the printing apparatus is the decrease in the number of paper jams. Since the path that the substrate 70 travels along in the printer is substantially straight, substrate jams that are often associated with a curved pathway, are eliminated almost entirely.

The liquid development system described above can also be adapted for color printing. FIG. 2 illustrates a color printer that utilizes four different color toners to produce a colored document. the colors must include black ink and may include a combination of blue, yellow, red, and green inks. The liquid color development system 200 comprises four toner feeder units 120*a*, 120*b*, 120*c*, and 120*d*. Each of the toner units is connected to a liquid development system similar to that described above and shown in FIG. 1.

The first feeder unit 120*a* may contain red toner is attached to the ink head assembly 50 of the first liquid development system by a transfer tube 115. The ink head assembly 50 advances red color toner suspended in oil to the electrostatic latent image on the photoconductor 40. The red color toner attaches to the discharged areas of the latent image by electrophoresis. The electrostatic latent image on the photoconductor 40 is produced in the same fashion as described above and shown in FIG. 1.

Once the electrostatic latent image on the photoconductor 40 is developed into a red image it is transferred to the transfer drum 60 by direct impression. The red developed image is then transferred from the transfer drum 60 to a paper 70 by direct contact impression. The paper 70 is advanced between the transfer drum 60 and an impression roller 95 in a straight path from a roll of paper 500 by advancing rollers 110.

Once the paper 70 is between the transfer drum 60 and the impression roller 95, the paper 70 is pressed firmly against the transfer drum 60 by the impression roller 95. This causes the red developed image on the transfer drum 60 to be transferred to the paper 70. Immediately after the red image is transferred to the paper 70, it is dried by dryer unit 75.

The paper 70 having the dried red developed image continues to advance in a straight path towards the second color liquid development system by advancing rollers 110. The second color liquid development system applies a second color on top of the red color image in the paper 70. This is achieved in the same fashion in which the first liquid color was applied to paper 70. Immediately after the second developed colored image is transferred to the paper 70 it is dried by dryer unit 75. The paper 70, having an image containing at least two colors, continues to be advanced in a straight paper path towards the third color development system so that the third color can be applied. This process is repeated until all colors have been applied onto the paper 70. In the event that a single colored document is to be printed, e.g., only black is needed, three of the four-color printing assemblies can be by-passed so that a single colored document is produced.

Liquid Ink Preferred Embodiments

Exemplary embodiment #1

A liquid ink developer comprised of a silicone oil carrier liquid of 10 cs viscosity and an in situ prepared acrylate polymer of 3000 to 5000 molecular weight and sub-micron pigment particles dispersed therein.

The preferred carrier silicone oil is a polydimethylsiloxane such as is commercially available from Toray Silicone Company, Ltd. or from Shin-Etsu Polymer Company, Ltd. or in the United States from Dow Chemical Company or General Electric. Preferred silicone oil have excellent thermal stability, no odor and no known environmental pollution problems.

The acrylate polymer (polymeric binder) is prepared by polymerizing in situ an acrylate polymer prepared from the following monomers: vinyl acetate (67% by weight), 2-ethylhexylmethacrylate (28% by weight), ethylene glycol dimethacrylate (1.5% by weight) and N-vinyl-2-pyrolidone (3.5% by weight). The monomers are dissolved in hexane, heated to 80 degrees C and polymerized for 2 hours using AIBN polymerization initiator all within an inert Nitrogen atmosphere. The resulting acrylate polymer has a molecular weight of approximately 3000 to 5000.

The sub-micron toner pigment particles comprise black, blue, yellow and magenta pigments commercially available from Dainichi Seika Corporation. Specifically, the preferred pigment for blue is CU-phthalocyanine (Chromofine Blue #Zca901), for yellow is an AZO dye (Chromofine Yellow #2700L), for magenta is a dye (Chromofine Magenta), and for black is, for example, carbon black (Printex G made by Degussa Japan Company, Ltd).

The charge control agent is preferably Ken-REACT K-R46B commercially available from Kenrich Petrochemical Company (tetraoctyl-bis-tridecyl-phosphitetitanate).

The acrylate polymer, toner pigments and charge control agents are dispersed in the carrier silicone oil such that the resulting ink has a uniform dispersion of toner particles with an average particle size of 0.3 to 0.5 microns.

While the invention has been illustrated and described in detail in the drawings and foregoing description, such illustration and description is to be considered as exemplary and not restrictive in character, it being understood that only the preferred embodiment and minor variants thereof have been shown and described and that all changes and modifications that come within the spirit of the invention are desired to be protected.

What is claimed is:

1. A liquid developer ink for developing latent electrostatic images, said ink comprising:

a silicone oil carrier;

sub-micron toner particles;

a charge control agent moiety adsorbed by said toner particles, and an acrylate polymer binder for substantially uniformly dispersing said toner particles and said charge control agent moiety within said silicone oil carrier, wherein said carrier comprises less than 60% by volume of said ink and wherein said ink has a viscosity of greater than 10000 cs and wherein said silicone oil carrier has a low dielectric value to enable migration of said toner particles within said carrier.

2. The ink of claim 1 wherein said silicone oil carrier comprises:

a polydimethylsiloxane having a viscosity of approximately 10 cs.

3. The ink of claim 1 wherein said acrylate polymer comprises:

an in situ polymerized acrylate having a molecular weight of less than approximately 5000.

4. The ink of claim 3 wherein said in situ polymerized acrylate has a particle size of less than approximately 0.5 microns.

5. The ink of claim 1 wherein said charge control agent moiety comprises:

a titanate imparting a positive charge to said pigment particles.

6. In an electrophotographic printing system having a liquid development system comprising a rotatable photoconductor, a rotatable roller assembly for applying a chargeable pre-wetting oil to the surface of the photoconductor, a charging unit that charges the pre-wetting oil on the photoconductor, a discharging unit that discharges selected areas of the pre-wetting oil to produce an electrostatic latent image on the photoconductor, and an ink head assembly to apply a liquid ink onto the electrostatic latent image to produce a developed image, an improved printing system the improvement comprising:

the pre-wetting oil having a viscosity of less than approximately 1 cs; and the liquid ink having a viscosity of greater than approximately 10000 cs wherein said liquid ink includes toner particles suspended in a carrier material that has a low dielectric value to enable migration of said toner particles within said carrier.

7. The improved printing system of claim 6 wherein said liquid ink further comprises:

a silicone oil carrier;

sub-micron pigment particles;

a charge control agent moiety adsorbed by said pigment particles; and an acrylate polymer binder for substantially uniformly dispersing said pigment particles and said charge control agent moiety within said silicone oil carrier, wherein said carrier comprises less than 60% by volume of said ink.

8. The improved printing system of claim 6 wherein said silicone oil carrier comprises:

a polydimethylsiloxane having a viscosity of approximately 10 cs.

9. The improved printing system of claim 6 wherein said acrylate polymer comprises:

an in situ polymerized acrylate having a molecular weight of less than approximately 5000.

10. The improved printing system of claim 9 wherein said in situ polymerized acrylate has a particle size of less than approximately 0.5 microns.

11. The improved printing system of claim 6 wherein said charge control agent moiety comprises:

a titanate imparting a positive charge to said pigment particles.

* * * * *